US011324265B2

(12) United States Patent
Holmes

(10) Patent No.: US 11,324,265 B2
(45) Date of Patent: May 10, 2022

(54) POCKET FOR A GARMENT

(71) Applicant: LULULEMON ATHLETICA CANADA INC., Vancouver (CA)

(72) Inventor: Brenda Holmes, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 95 days.

(21) Appl. No.: 16/357,067

(22) Filed: Mar. 18, 2019

(65) Prior Publication Data

US 2019/0297972 A1 Oct. 3, 2019

Related U.S. Application Data

(60) Provisional application No. 62/650,256, filed on Mar. 29, 2018.

(51) Int. Cl.

| | |
|---|---|
| ***A41D 27/20*** | (2006.01) |
| ***A41D 1/089*** | (2018.01) |
| ***A41F 9/02*** | (2006.01) |

(52) U.S. Cl.

CPC ..... *A41D 27/205* (2013.01); *A41D 1/089* (2018.01); *A41D 27/207* (2013.01); *A41F 9/025* (2013.01); *A41D 2300/22* (2013.01)

(58) Field of Classification Search

CPC .... A41D 27/205; A41D 27/207; A41D 1/089; A41D 2300/22; A41D 1/08; A41F 9/025; A41F 9/00

See application file for complete search history.

(56) References Cited

U.S. PATENT DOCUMENTS

| | | | | |
|---|---|---|---|---|
| 1,491,979 | A * | 4/1924 | Wood | A41D 27/207 2/254 |
| 2,900,643 | A * | 8/1959 | Varnhagen | A41D 1/21 2/221 |
| 4,057,854 | A * | 11/1977 | Phelps, Sr. | A41D 15/04 2/128 |
| 6,772,446 | B1 * | 8/2004 | Black | A41B 9/04 2/400 |
| D661,871 | S | 6/2012 | Savage | |
| D687,214 | S | 8/2013 | Farina et al. | |
| D754,948 | S | 5/2016 | Cockram | |

(Continued)

*Primary Examiner* — Shaun R Hurley
*Assistant Examiner* — Bao-Thieu L Nguyen
(74) *Attorney, Agent, or Firm* — Conneely PC; Joseph Conneely

(57) ABSTRACT

A pocket structure for a waistband of a garment, comprising: an outer pocket panel attached to an inner pocket panel along respective first side edges, second side edges, and bottom edges thereof forming a pocket therebetween and a back portion of the waistband; wherein respective unattached top edges of the outer and inner pocket panels are narrower than the respective bottom edges thereof. And, a waistband for a garment, comprising: an outer pocket panel attached to an inner pocket panel along respective first side edges, second side edges, and bottom edges thereof forming a pocket therebetween and a back portion of the waistband; and, a front portion of the waistband attached to the back portion of the waistband along respective first side edges and second side edges thereof; wherein respective unattached top edges of the outer and inner pocket panels are narrower than the respective bottom edges thereof.

10 Claims, 14 Drawing Sheets

(56) References Cited

U.S. PATENT DOCUMENTS 9,474,655 B1 * 10/2016 Biondolillo ..... A61F 13/84
RE46,331 E 3/2017 Savage
D793,665 S 8/2017 Perez
D812,348 S 3/2018 McManus et al.
D816,303 S 5/2018 Diakonov
10,010,158 B2 7/2018 Do
D825,144 S 8/2018 Lorett
D835,885 S 12/2018 Park
D850,063 S 6/2019 Holmes
10,366,798 B2 * 7/2019 Sexton ..... A41D 27/205
10,555,572 B2 * 2/2020 Diakonov ..... A41D 1/08
10,575,565 B2 * 3/2020 Trebino ..... A41F 17/00
10,667,569 B2 * 6/2020 Fay ..... F41C 33/048
10,687,570 B2 * 6/2020 Strange ..... A41D 1/06
2012/0311758 A1 * 12/2012 Nicholson ..... A41D 27/20 2/67
2012/0311761 A1 * 12/2012 Luginbuhl ..... A41D 27/205 2/69
2013/0048687 A1 2/2013 Do
2013/0232652 A1 * 9/2013 Kalaam ..... F41H 1/02 2/2.5
2013/0305433 A1 * 11/2013 Hedrick ..... A41D 31/185 2/220
2014/0182044 A1 * 7/2014 Cole ..... A41D 27/208 2/69
2015/0007379 A1 * 1/2015 Cockram ..... A41D 13/0015 2/236
2015/0366280 A1 * 12/2015 Fay ..... F41C 33/046 2/311
2016/0007662 A1 * 1/2016 Powell ..... A41D 27/08 2/228
2016/0120251 A1 * 5/2016 Grafenstein-Kinzel ..... B25H 3/00 2/300
2016/0331053 A1 * 11/2016 Gordon ..... A41D 7/00
2017/0238634 A1 * 8/2017 Berns ..... A41D 27/207
2017/0325512 A1 * 11/2017 Trebino ..... A41B 9/001
2018/0035736 A1 * 2/2018 Le ..... A41D 27/20
2018/0160751 A1 * 6/2018 Epp Frenette ..... A45F 5/02
2018/0199633 A1 * 7/2018 Henry ..... A41F 9/00
2018/0206567 A1 * 7/2018 Diakonov ..... A41D 13/0012
2018/0289085 A1 * 10/2018 Strange ..... A41F 9/007
2020/0068968 A1 * 3/2020 Robinson ..... F41C 33/0209

* cited by examiner

POCKET FOR A GARMENT

This application claims priority from and the benefit of the filing date of U.S. Provisional Patent Application No. 62/650,256, filed Mar. 29, 2018, and the entire content of such application is incorporated herein by reference.

FIELD OF THE APPLICATION

This application relates to the field of sports apparel, and more specifically, to a pocket for a waistband of a garment such as a pair of shorts or pants.

BACKGROUND OF THE APPLICATION

Consumers are demanding high performance activewear and sportswear. This is especially so for garments used for running and yoga such as shorts and pants. Such garments should be as snug as possible but must still provide adequate room for holding personal items such as smart phones and keys. Moreover, such garments should remain flexible to keep a wearer comfortable during stretching, exercising, and other athletic performance.

One problem with existing shorts and pants is that they often have pockets located in positions that interfere with a wearer's movements. In addition, such pockets often do not adequately secure valuable personal items, such as smart phones and keys, when the wearer is engaged in stretching, exercising, and athletic performance.

A need therefore exists for an improved pocket for a garment. Accordingly, a solution that addresses, at least in part, the above and other shortcomings is desired.

SUMMARY OF THE APPLICATION

According to one aspect of the application, there is provided a pocket structure for a waistband of a garment, comprising: an outer pocket panel attached to an inner pocket panel along respective first side edges, second side edges, and bottom edges thereof forming a pocket therebetween and a back portion of the waistband; wherein respective unattached top edges of the outer and inner pocket panels are narrower than the respective bottom edges thereof.

According to another aspect of the application, there is provided a waistband for a garment, comprising: an outer pocket panel attached to an inner pocket panel along respective first side edges, second side edges, and bottom edges thereof forming a pocket therebetween and a back portion of the waistband; and, a front portion of the waistband attached to the back portion of the waistband along respective first side edges and second side edges thereof; wherein respective unattached top edges of the outer and inner pocket panels are narrower than the respective bottom edges thereof.

BRIEF DESCRIPTION OF THE DRAWINGS

Features and advantages of the embodiments of the present application will become apparent from the following detailed description, taken in combination with the appended drawings, in which.

It will be noted that throughout the appended drawings, like features are identified by like reference numerals.

DETAILED DESCRIPTION OF EXAMPLE EMBODIMENTS

In the following description, details are set forth to provide an understanding of the application. In some instances, certain structures, techniques, and methods have not been described or shown in detail in order not to obscure the application.

Figure 1:
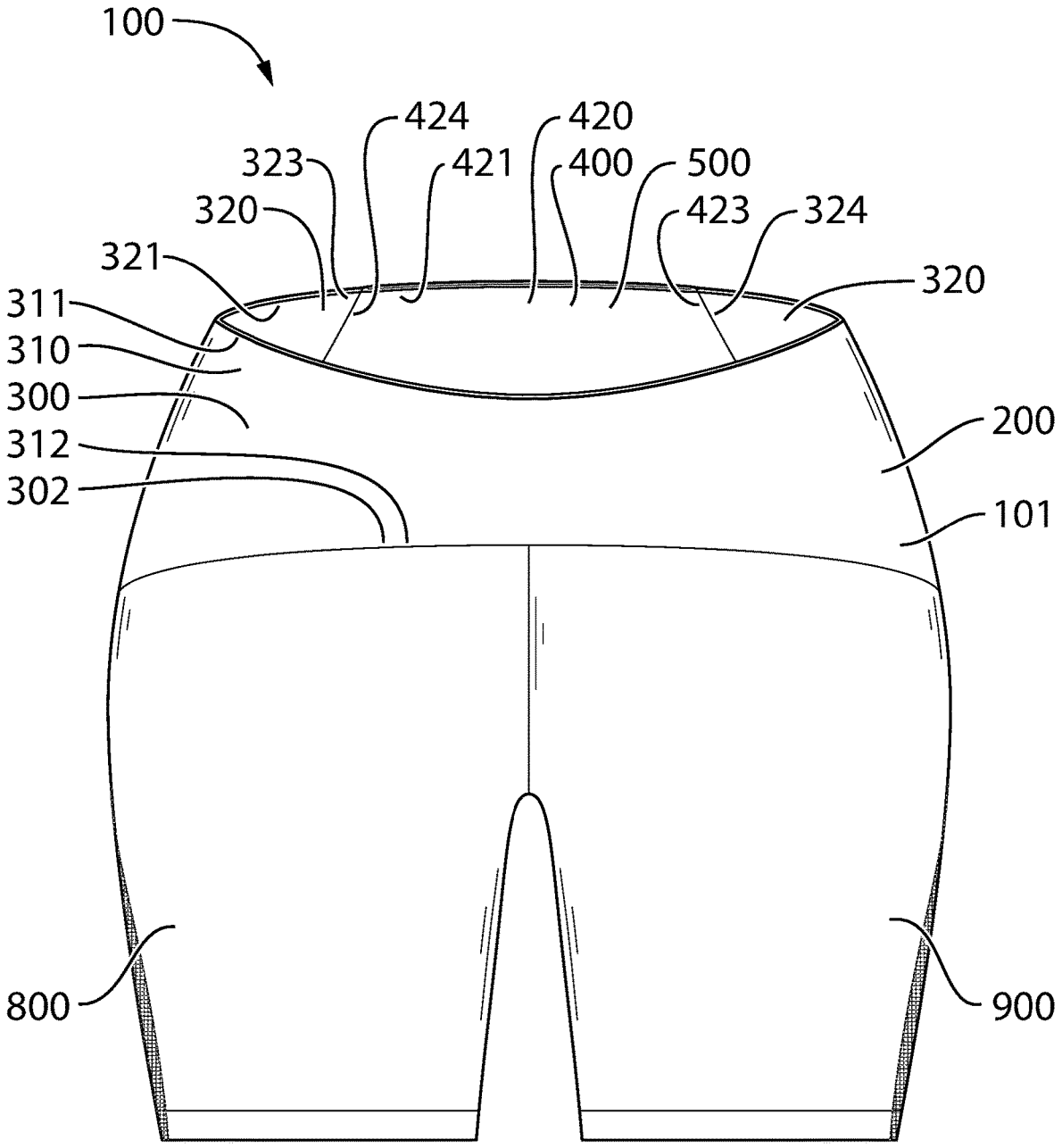
FIG. 1 is a front view illustrating a garment having a pocket formed in the waistband thereof in accordance with an embodiment of the application.
Figure 2:
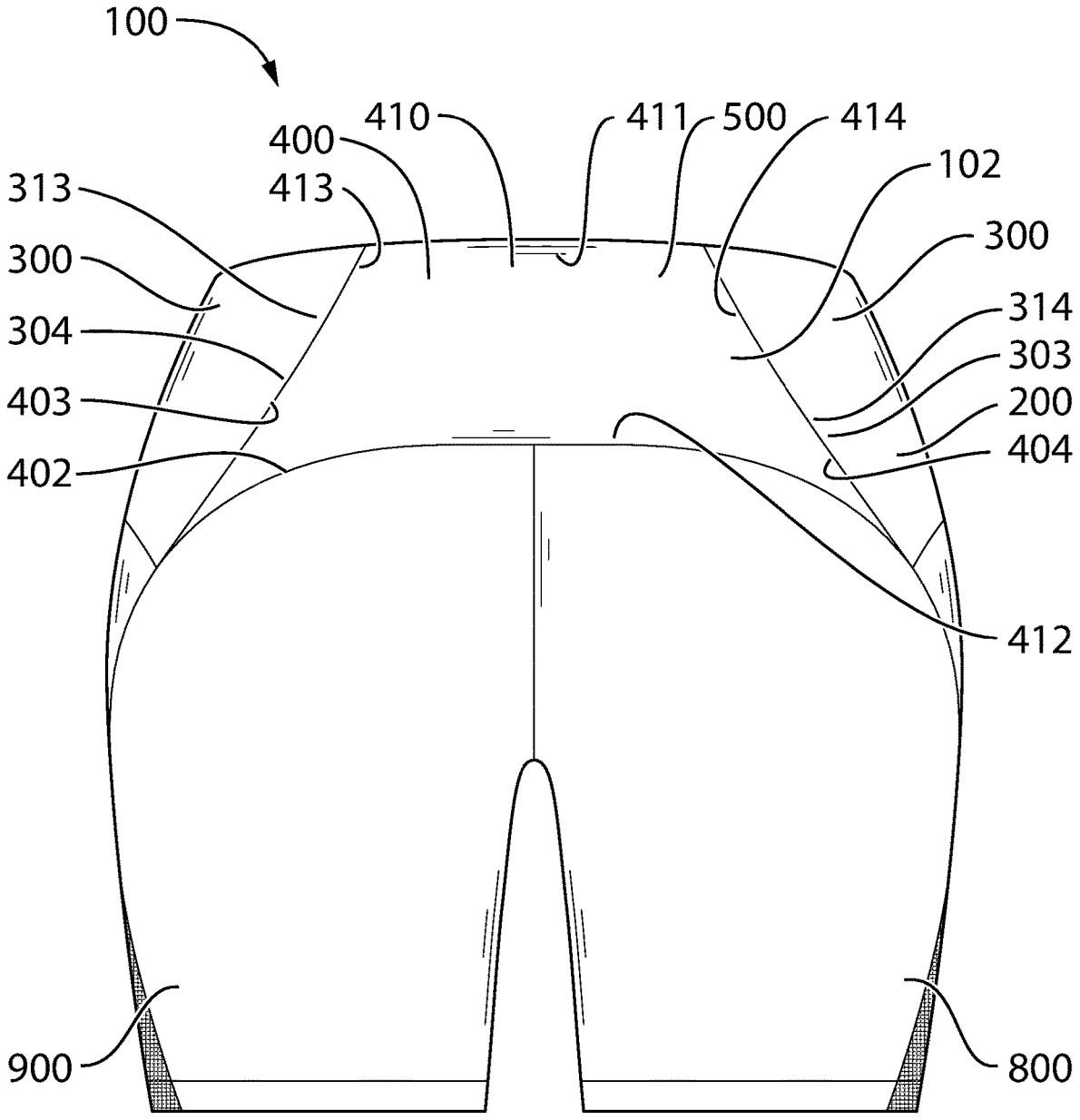
FIG. 2 is rear view thereof.
Figure 3:
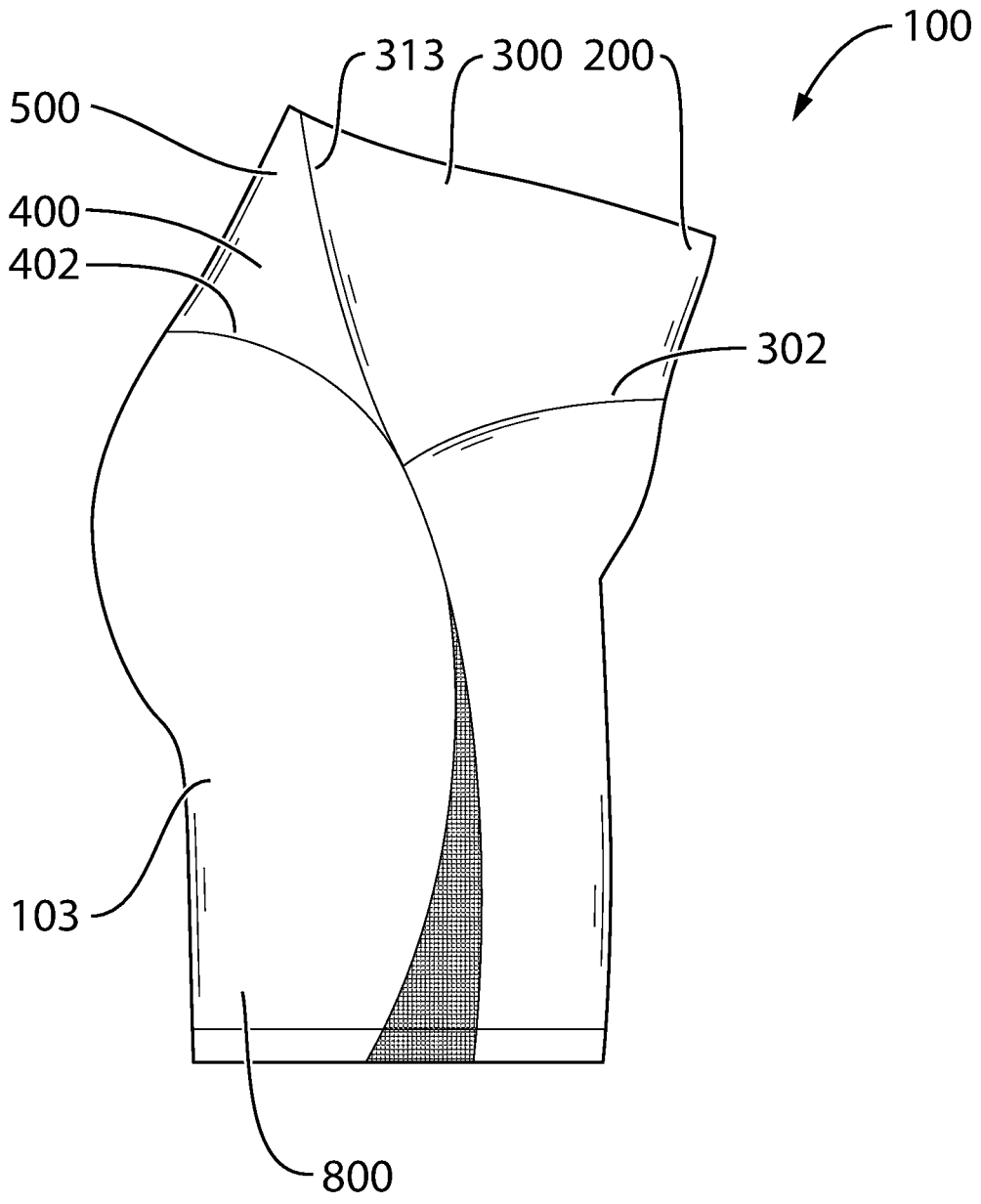
FIG. 3 is a left side view thereof.
Figure 4:
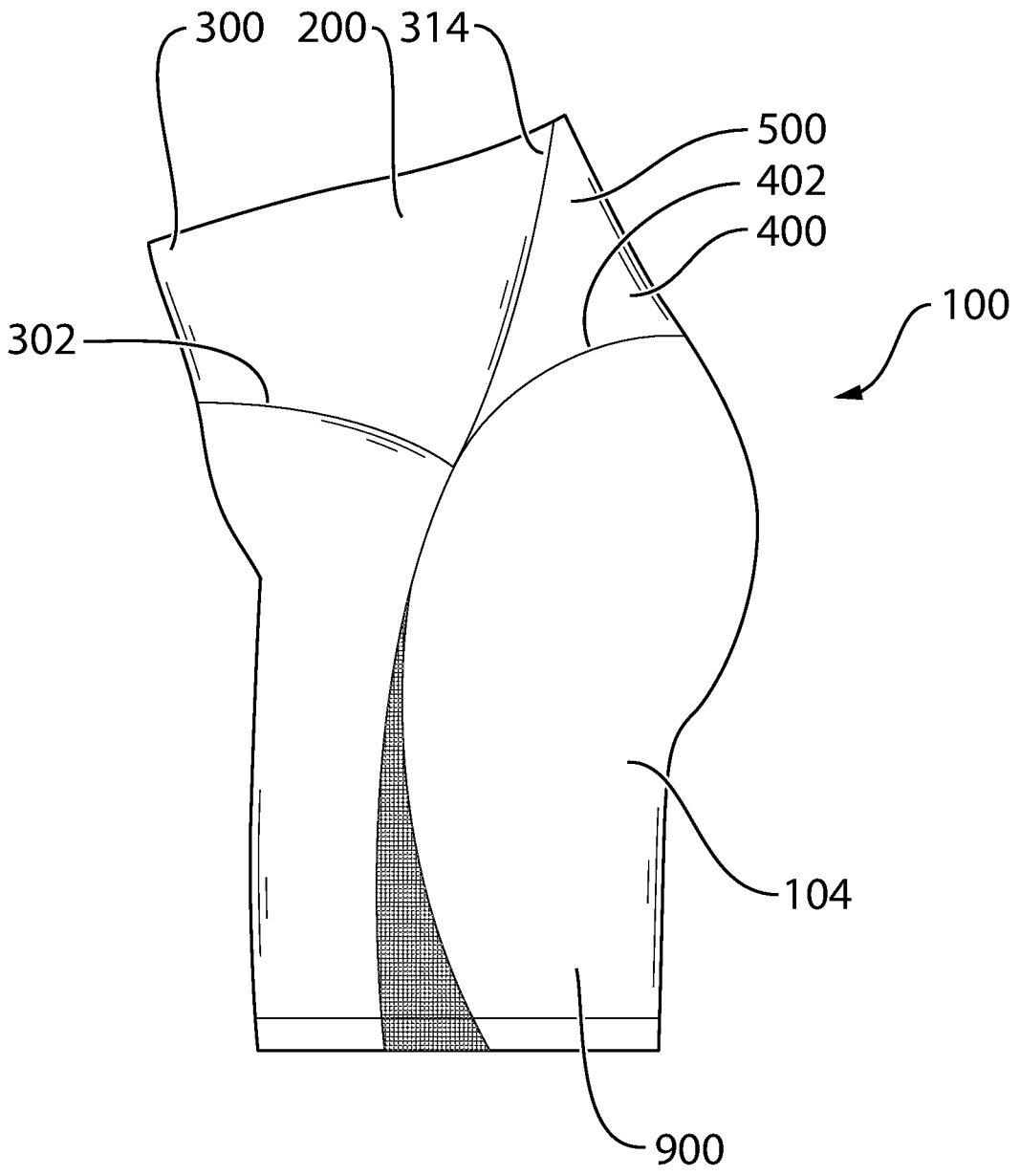
FIG. 4 is a right side view thereof.
Figure 5:
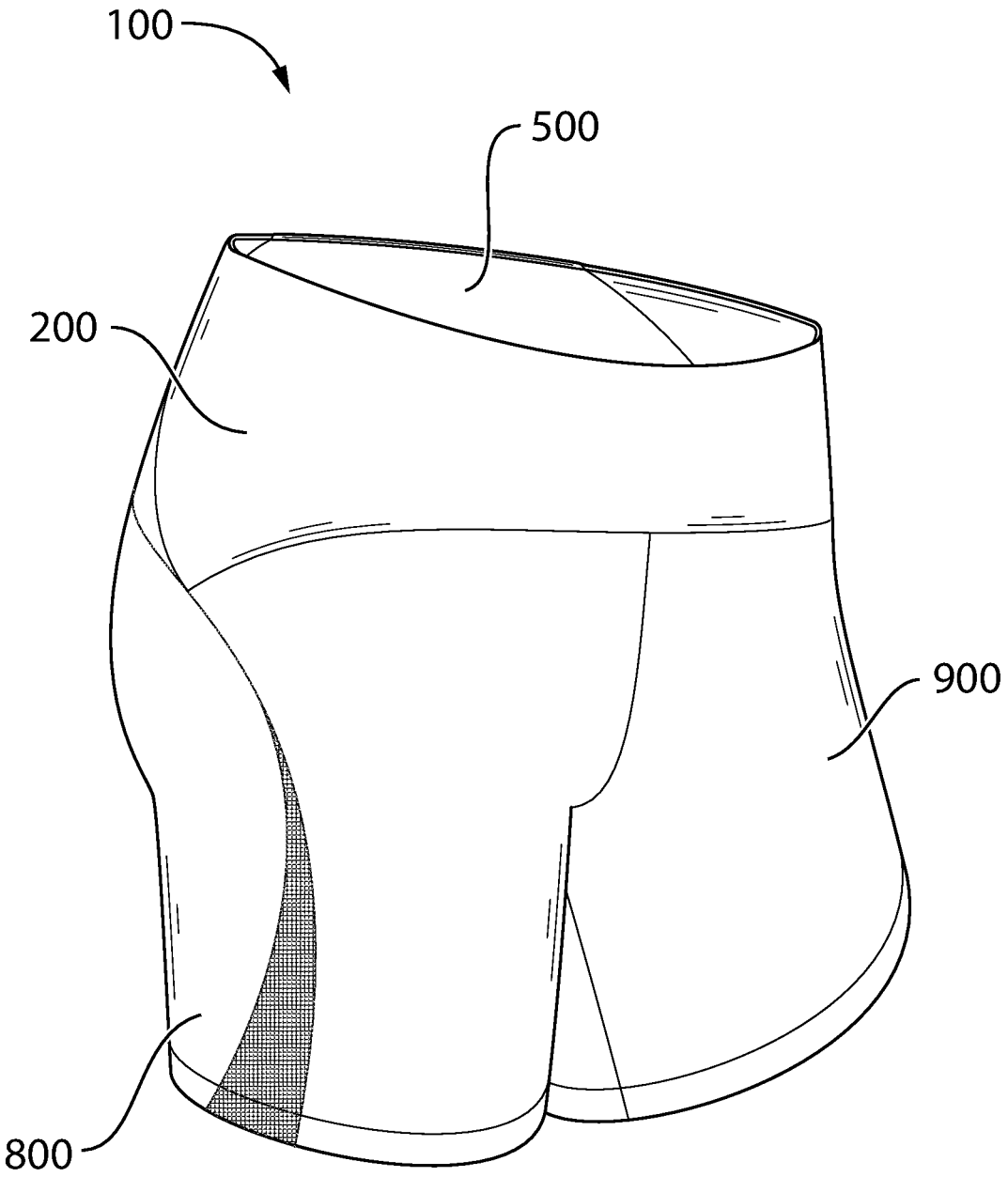
FIG. 5 is front perspective view thereof.
Figure 6:
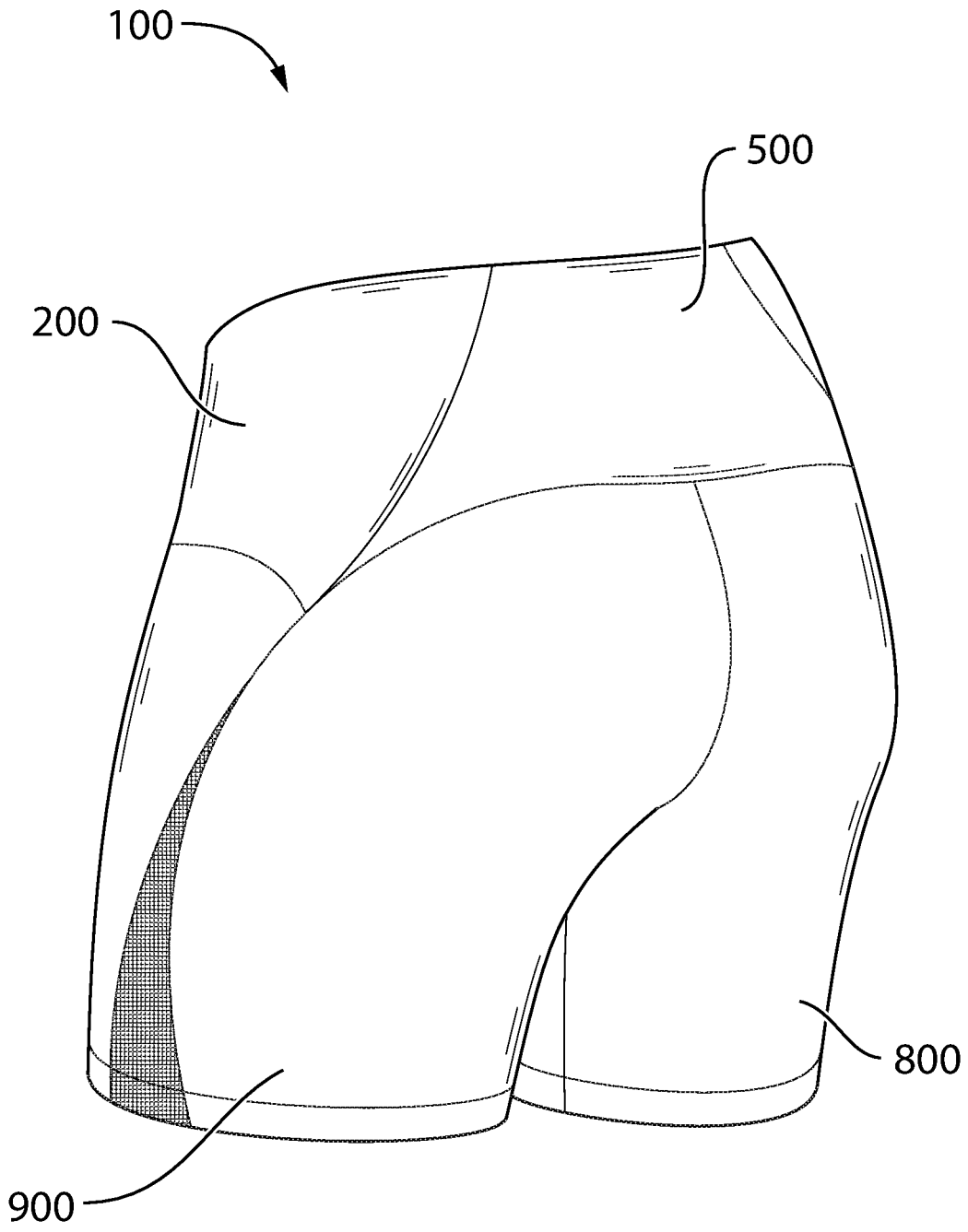
FIG. 6 is a rear perspective view thereof.
Figure 7:
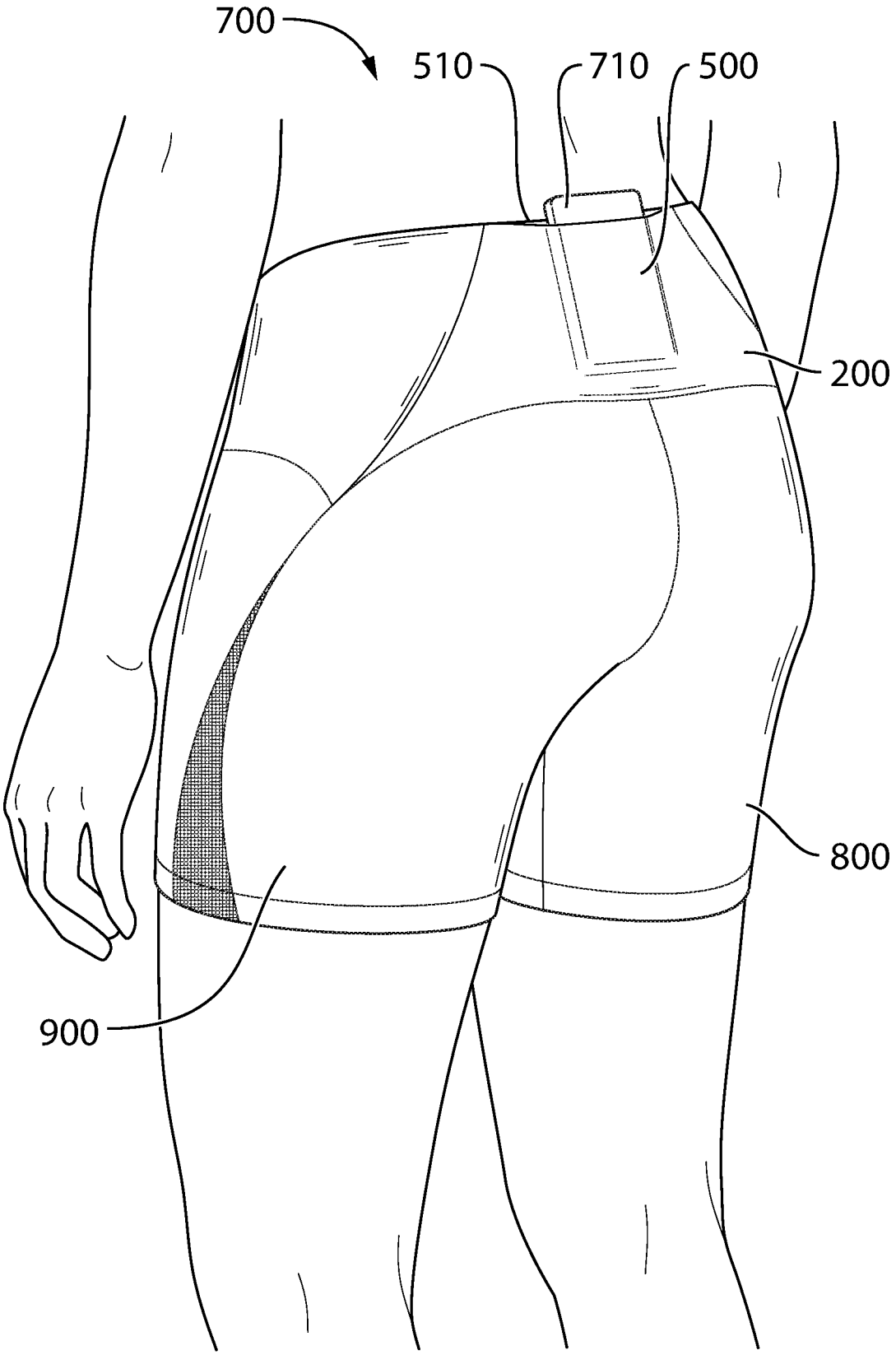
FIG. 7 is a rear environmental view thereof illustrating the positioning of the garment on a wearer's body and with a smart phone partially inserted into the pocket.
Figure 8:
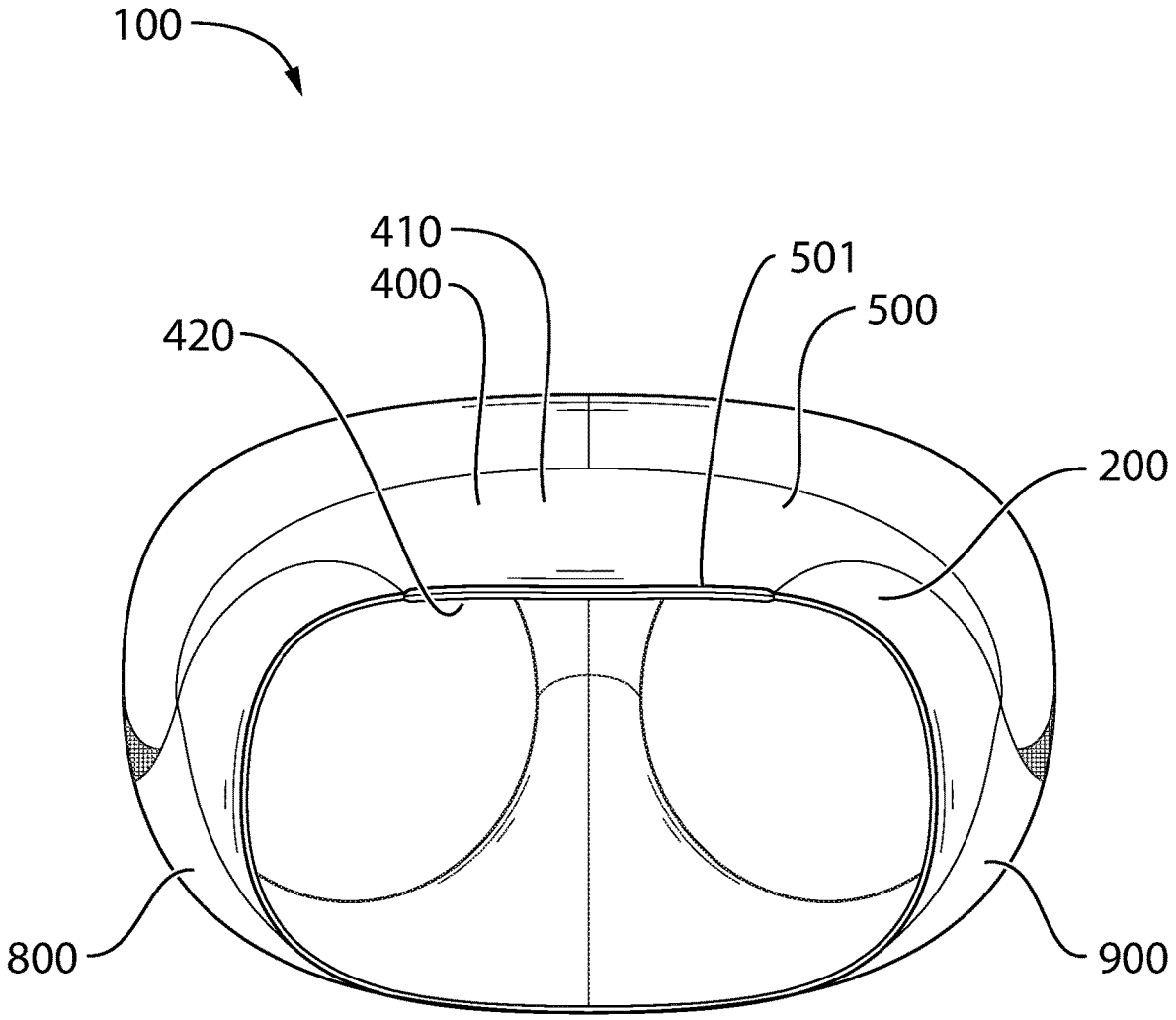
FIG. 8 is a top view thereof with the pocket shown in a closed position.
Figure 9:
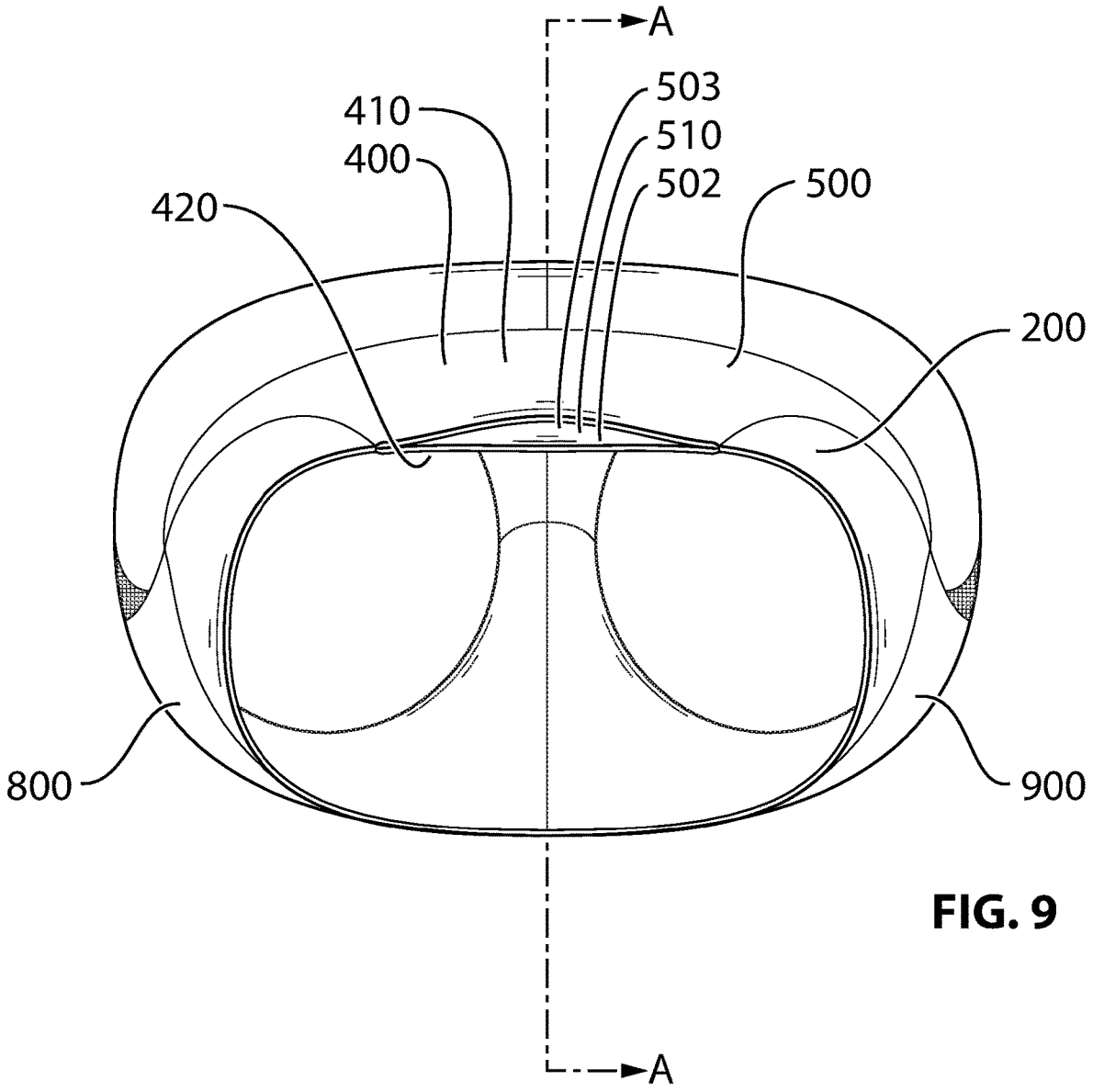
FIG. 9 is a top view thereof with the pocket shown in an opened position.
Figure 10:
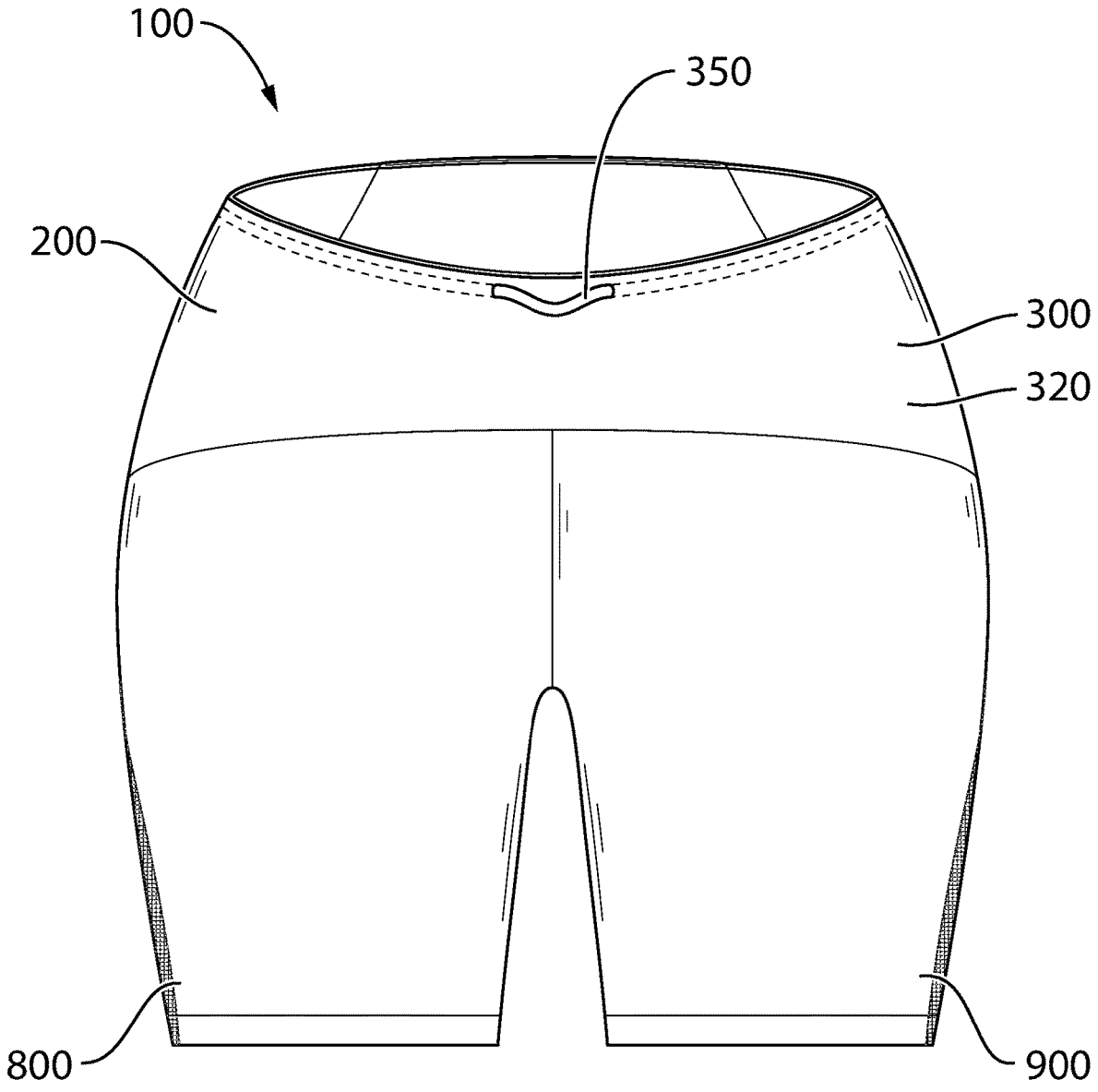
FIG. 10 is a front inside-out view thereof.
Figure 11:
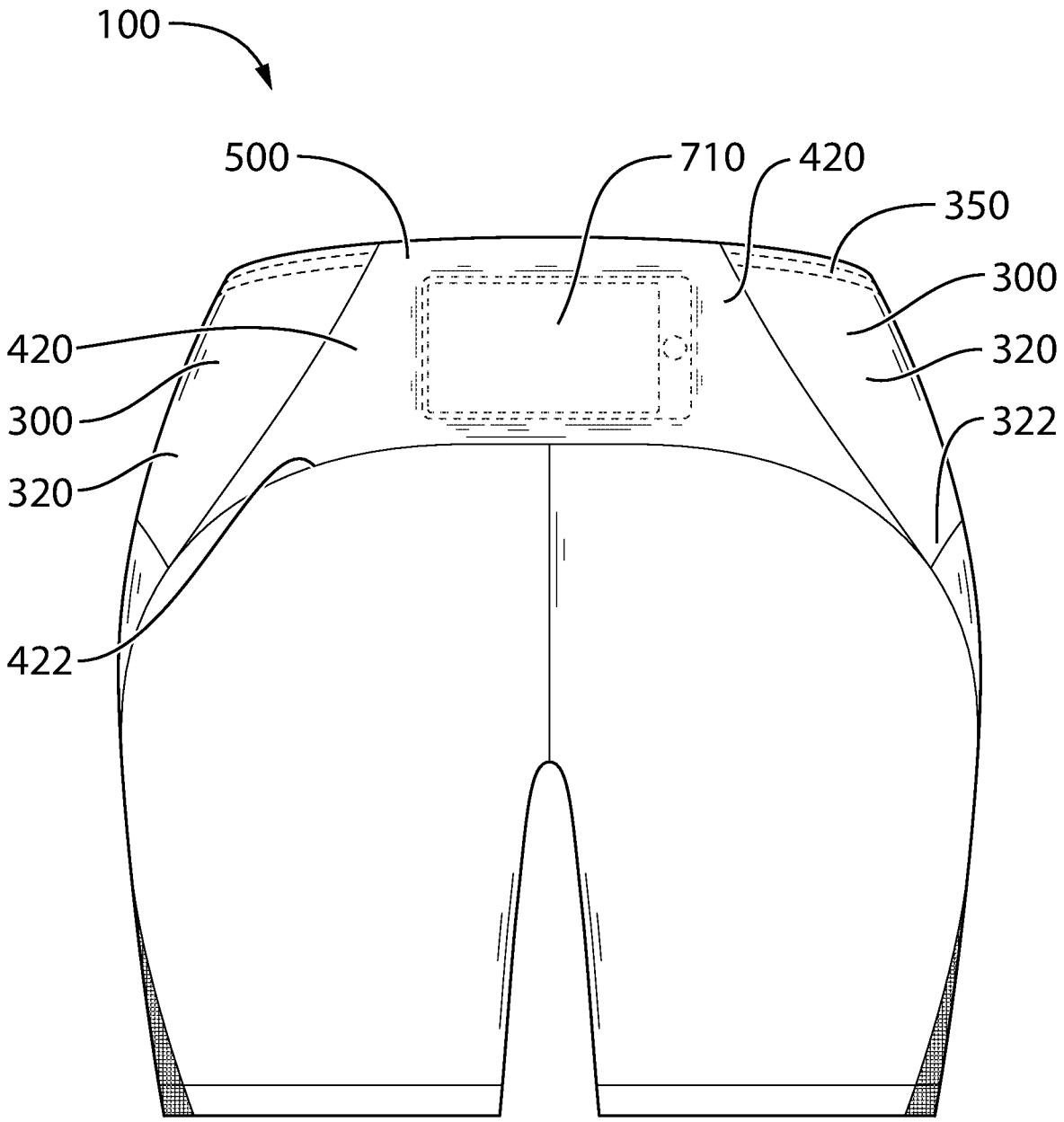
FIG. 11 is a rear inside-out view thereof
Figure 12:
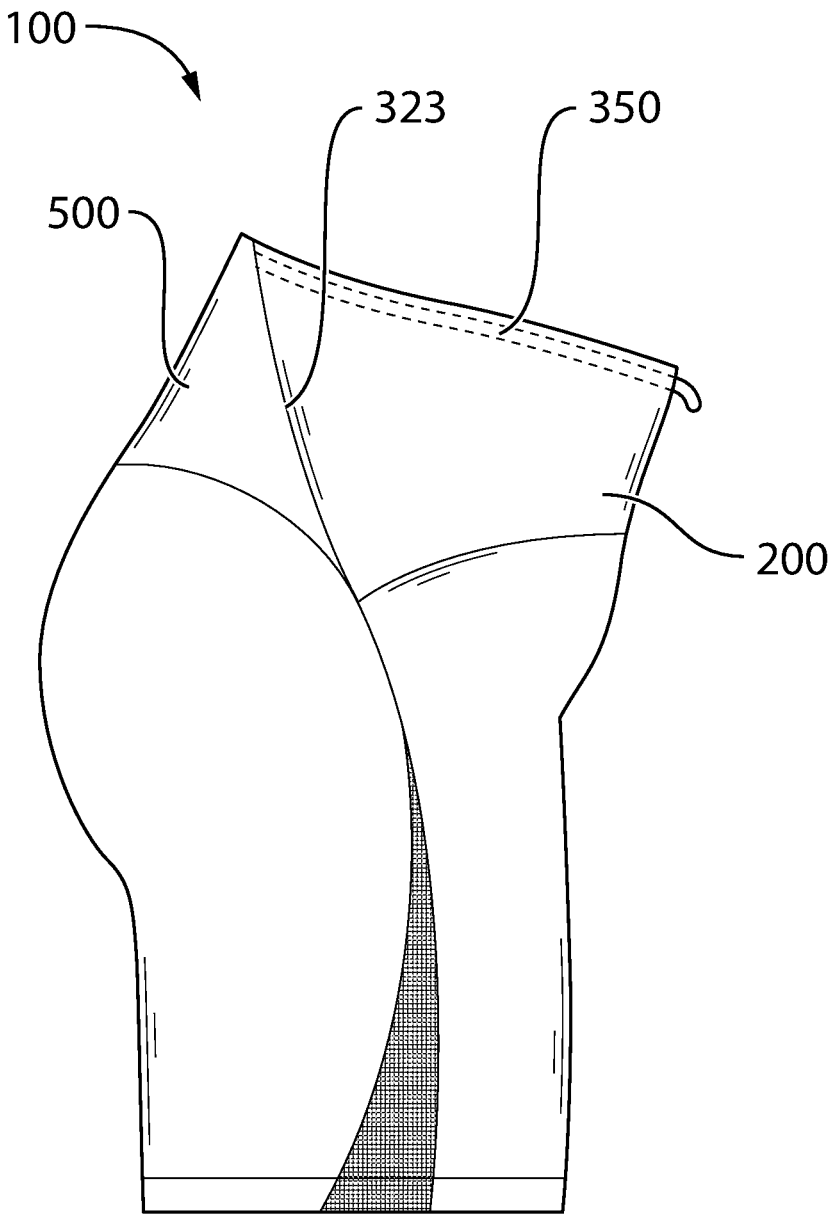
FIG. 12 is a left side inside-out view thereof.
Figure 13:
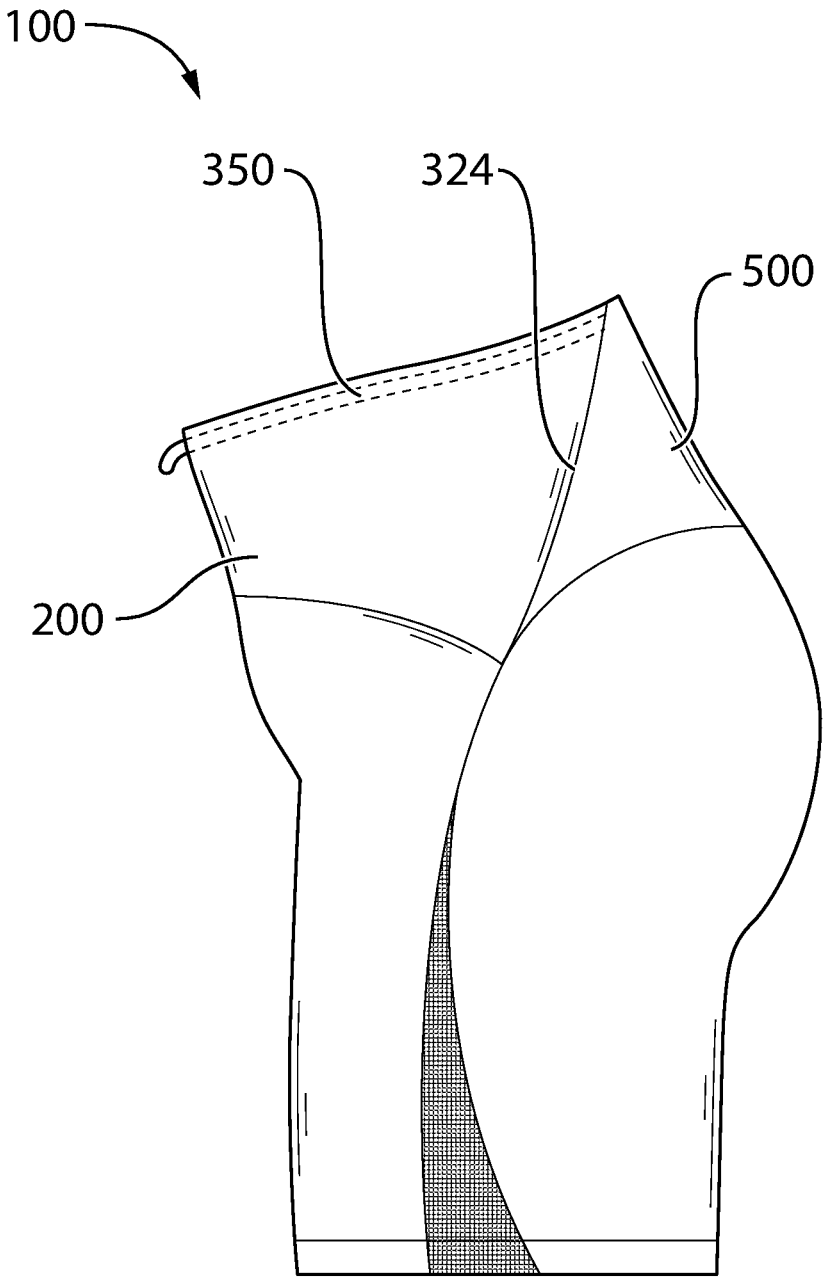
FIG. 13 is a right side inside-out view thereof.
Figure 14:
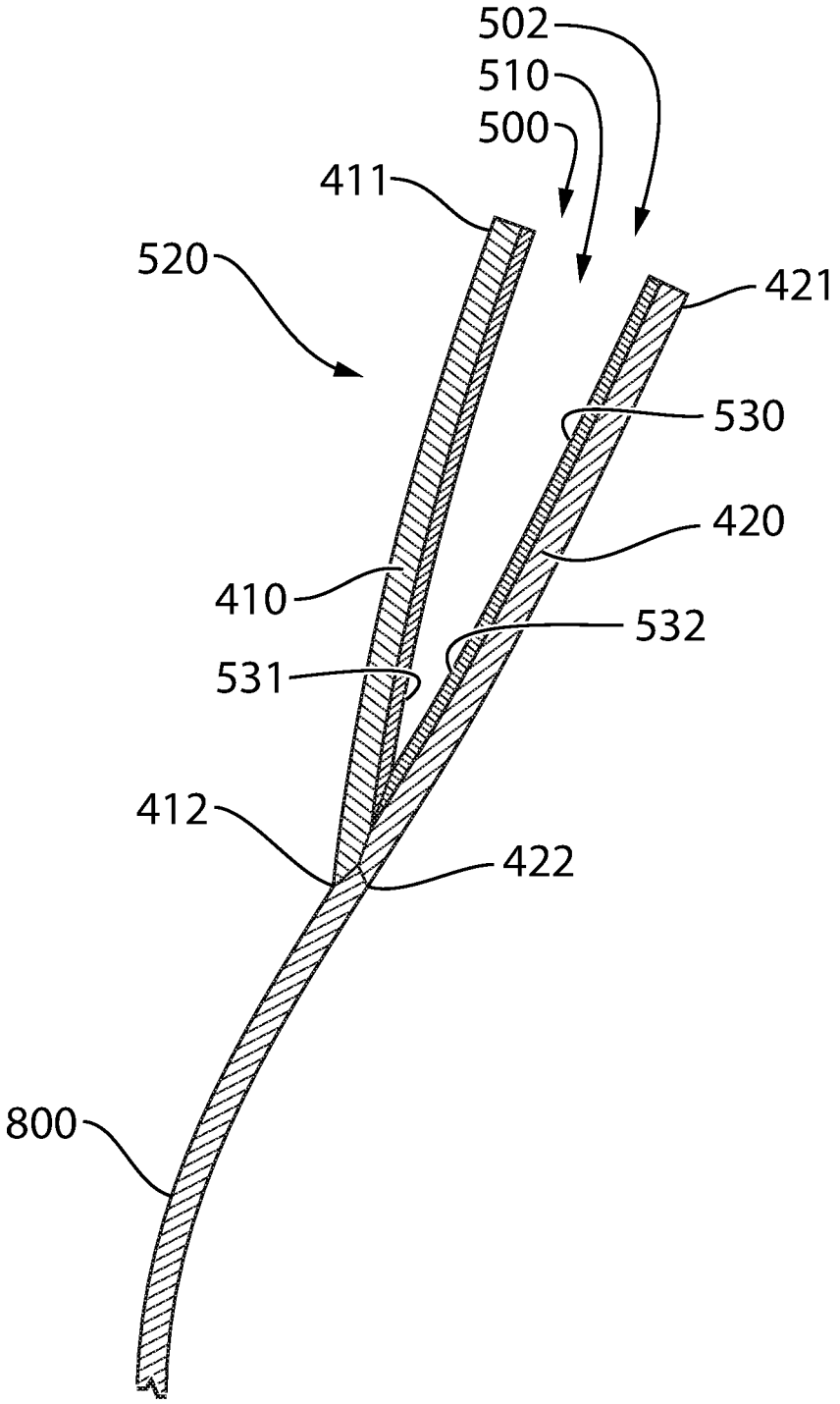
FIG. 14 is a cross-sectional detail view of the pocket thereof taken along line A-A in FIG. 9.

FIG. 1 is a front view illustrating a garment 100 having a pocket 500 formed in the waistband 200 thereof in accordance with an embodiment of the application. FIG. 2 is rear view thereof. FIG. 3 is a left side view thereof. FIG. 4 is a right side view thereof. FIG. 5 is front perspective view thereof. FIG. 6 is a rear perspective view thereof. FIG. 7 is a rear environmental view thereof illustrating the positioning of the garment 100 on a wearer's body 700 and with a smart phone 710 partially inserted into the pocket 500. FIG. 8 is a top view thereof with the pocket 500 shown in a closed position 501. FIG. 9 is a top view thereof with the pocket 500 shown in an opened position 502. FIG. 10 is a front inside-out view thereof. FIG. 11 is a rear inside-out view thereof. FIG. 12 is a left side inside-out view thereof. FIG. 13 is a right side inside-out view thereof. And, FIG. 14 is a cross-sectional detail view of the pocket 500 thereof taken along line A-A in FIG. 9.

According to one embodiment of the application, a garment 100 such as a sports garment, shorts, pants, skirt, or skort is provided. The garment 100 includes a waistband 200 having a pocket 500 formed therein and first and second or left and right legs 800, 900 attached or connected (e.g., glued, sewn, etc.) to the waistband 200. The pocket 500 is suitable for holding and securing items such as a wireless device, mobile device, cellular telephone, or smart phone 710 as shown in FIG. 7.

The waistband 200 includes: an elongate front portion 300 positioned at the front 101 of the garment 100 and wrapping around the left and right sides 103, 104 of the garment 100; an elongate back portion 400 positioned at the back 102 of the garment 100; and, an optional drawstring or drawcord 350 for tightening the waistband 200 of the garment 100 against the waist of a wearer 700. The left side edge 303 of the front portion 300 is attached to the right side edge 404 of the back portion 400 and the right side edge 304 of the front portion 300 is attached to the left side edge 403 of the back portion 400 to complete the waistband 200. The top edges of the left and right legs 800, 900 of the garment 100 are attached to the bottom edges 302, 402 of the front and back portions 300, 400 of the waistband 200.

According to one embodiment, the front portion 300 of the waistband 200 may include an outer panel (or fabric panel) 310 attached to an inner panel (or fabric panel) 320 along respective top edges 311, 321, bottom edges 312, 322, left (or first) side edges 313, 323, and right (or second) side edges 314, 324. According to one embodiment, the front portion 300 may consist of one piece of fabric that is folded over along the top edges 311, 321 to form the outer panel 310 and the inner panel 320.

According to one embodiment, the pocket 500 is formed in the back portion 400 of the waistband 200. In particular, the back portion 400 of the waistband 200 may include an outer pocket panel (or fabric panel) 410 attached to an inner pocket panel (or fabric panel) 420 along respective bottom edges 412, 422, left (or first) side edges 413, 423, and right (or second) side edges 414, 424. At least a portion of the respective top edges 411, 421 of the outer and inner pocket panels 410, 420 are not attached thus forming an opening 510 for the pocket 500 in the back portion 400 of the waistband 200. The outer pocket panel 410 and the inner pocket panel 420 thus form a pocket bag, assembly, or structure 520 providing a pocket 500 in the waistband 200 of the garment 100.

According to one embodiment, the front and back portions 300, 400 of the waistband 200 may be made from or include a stretchable, elastic fabric such as Lycra™, Luxtreme™, Luon™, spandex, elastane, or the like. When the garment 100 is worn, stretching of the front and back portions 300, 400 of the waistband 100 around the wear's waist introduces lateral tension in the waistband 200 which operates to draw or stretch the top edges 411, 421 of the outer and inner pocket panels 410, 420 of the back portion 400 of the waistband 200 together to maintain the pocket 500 in a closed position 501 as shown in FIG. 8. Advantageously, the pocket 500 may be maintained in the closed position 501 when worn without the need for a fastening device such as zipper, Velcro™, or buttons.

According to one embodiment, the garment includes an optional drawstring or drawcord 350 for tightening the waistband 200 of the garment 100 against the waist of a wearer 700. The drawcord 350 may be positioned or encased in fabric on the inside of the garment 100 below the upper edge 321 of the inner panel 320 of the front portion 300 of the waistband 200 as shown in FIGS. 10 to 13. According to one embodiment, the drawcord 350 does not extend through the back portion 400 of the waistband 200. As such, when the drawcord 350 is tightened by a wearer, the drawcord 350 further increases lateral tension in the waistband 200 which again operates to draw or stretch the top edges 411, 421 of the outer and inner pocket panels 410, 420 of the back portion 400 of the waistband 200 together to maintain the pocket in the closed position 501.

According to one embodiment, the widths of the top edges 411, 421 of the outer and inner pocket panels 410, 420, and hence the width of the opening 510 of the pocket 500, is less than the widths of the bottom edges 412, 422 of the outer and inner pocket panels 410, 420. As such, and advantageously, items such as an elongate smart phone 710 may be more securely held in the pocket 500. For example, the opening 510 of the pocket 500 may be sized to receive the end of a smart phone 710 and hold the smart phone in a vertical (or approximately vertical) position as shown in FIG. 7. The wearer may angle the smart phone 710 and fully insert the smart phone into the pocket 500 to rest in a horizontal (or approximately horizontal) position as shown in FIG. 11.

According to one embodiment, the pocket 500 and/or the back portion 400 of the waistband 200 and its outer and inner pocket panels 410, 420 are isosceles trapezoidal (or approximately isosceles trapezoidal) in shape. That is, the widths of the top edges 411, 421 of the outer and inner pocket panels 410, 420 are less than the widths of the bottom edges 412, 422 of the outer and inner pocket panels 410, 420, the left side edges 413, 423 of the outer and inner pocket panels 410, 420 are inclined, the right side edges 414, 424 of the outer and inner pocket panels 410, 420 are inclined, and the angles between the left side edges 413, 423 and the top edges 411, 412 of the outer and inner pocket panels 410, 420 are equal (or approximately equal) to the angles between the right side edges 414, 424 and the top edges 411, 412 of the outer and inner pocket panels 410, 420. For example, the ratio between the widths of the top edges 411, 421 of the outer and inner pocket panels 410, 420 to the bottom edges 412, 422 of the outer and inner pocket panels 410, 420 may be approximately 1:2.

According to one embodiment, the pocket 500 may include a pocket liner 530. The pocket liner 530 may include an outer pocket liner panel (or fabric panel) 531 and an inner pocket liner panel (or fabric panel) 532 attached to and lining the outer side of the inner pocket panel 420 and the inner side of the outer pocket panel 410, respectively, on the inside 503 of the pocket 500. The pocket liner 530 may be made from a moisture-wicking technical fabric such as Coolmax™.

According to one embodiment, when the garment 100 is worn, the outer pocket panel 410 is moveable from a closed position 501 in which the opening 510 into the pocket 500 is collapsed or closed to an opened position 502 in which the opening 510 into the pocket 500 is expanded or opened by a wearer inserting an item (e.g., a smart phone 710) or finger into the pocket 500 between the upper edges 411, 421 of the outer and inner pocket panels 410, 420 and pulling or stretching the upper edge 411 of the outer pocket panel 410 away from the upper edge 421 of the inner pocket panel 420. In the opened position 502, at least a portion of the inner side of the upper edge 411 of the outer pocket panel 410 is separated from the outer side of the upper edge 421 of the inner pocket panel 420 expanding the opening 510 through which items (e.g., 710) may be inserted into the pocket 500.

The outer pocket panel 410 is moveable from the opened position 502 in which the pocket opening 510 is expanded or opened 502 to the closed position 501 in which the pocket opening 510 is collapsed or closed 501 by a wearer removing an item (e.g., a smart phone 710) or finger from the pocket 500 between the upper edges 411, 421 of the outer and inner pocket panels 410, 420 and allowing the upper edge 411 of the outer pocket panel 410 to move toward and contact the upper edge 421 of the inner pocket panel 420 to close the opening 510 into the pocket 500. In the closed position 501, at least a portion of the inner side of the upper edge 411 of the outer pocket panel 410 is adjacent to or in contact with the outer side of the upper edge 421 of the inner pocket panel 420 closing the opening 510 into the pocket 500.

According to one embodiment, the pocket 500 may be located on the front 101, left side 103, or right side 104 of the waistband 200 of the garment 100. According to one embodiment, the garment 100 may include two or more pockets 500.

In operation, a wearer puts on the garment 100 by inserting his or her legs into the legs 800, 900 of the garment 100, pulling the waistband 200 up to their waist, and tightening the optional drawcord 350. Lateral tension within the waistband 200 when the garment 100 is worn functions to draw or stretch the top edges 411, 421 of the outer and inner pocket panels 410, 420 of the back portion 400 of the waistband 200 together to close the opening 510 into the pocket 500 and maintain the pocket 500 in a closed position 501. Items may be inserted into or removed from the pocket 500 by the wearer inserting an item or finger into the opening 510 and pulling the top edge 411 of the outer pocket panel 410 away from the top edge 421 of the inner pocket panel 420 to expand the opening 510 into the pocket 500.

Thus, according to one embodiment, there is provided a pocket structure 520 for a waistband 200 of a garment 100, comprising: an outer pocket panel 410 attached to an inner pocket panel 420 along respective first (or left) side edges 413, 423, second (or right) side edges 414, 424, and bottom edges 412, 422 thereof forming a pocket 500 therebetween and a back portion 400 of the waistband 200; wherein respective unattached top edges 411, 421 of the outer and inner pocket panels 410, 420 are narrower than the respective bottom edges 412, 422 thereof.

In the above pocket structure 520, the outer pocket panel 410 and the inner pocket panel 420 may be trapezoidal or approximately trapezoidal in shape. The outer pocket panel 410 and the inner pocket panel 420 may be isosceles trapezoidal or approximately isosceles trapezoidal in shape. The respective unattached top edges 411, 421 of the outer and inner pocket panels 410, 420 may form an opening 510 into the pocket 500. The back portion 400 of the waistband 200 may be attached to a front portion 300 of the waistband 200 along respective first (or left) side edges 403, 304 and second (or right) side edges 404, 303 thereof. The waistband 200 may be made of an elastic material. Lateral tension developed in the waistband 200 by stretching of the elastic material when the garment 100 is worn may maintain the opening 510 into the pocket 500 in a closed position 501. The waistband 200 may include a drawcord 350 for tightening the waistband 200 when the garment 100 is worn and thereby increasing the lateral tension in the waistband 200. The drawcord 350 may extend around the front portion 300 of the waistband 200 only. And, the respective unattached top edges 411, 421 of the outer and inner pocket panels 410, 420 may be unattached for at least a portion of their respective widths.

According to another embodiment, there is provided a waistband 200 for a garment 100, comprising: an outer pocket panel 410 attached to an inner pocket panel 420 along respective first (or left) side edges 413, 423, second (or right) side edges 414, 424, and bottom edges 412, 422 thereof forming a pocket 500 therebetween and a back portion 400 of the waistband 200; and, a front portion 300 of the waistband 200 attached to the back portion 400 of the waistband 200 along respective first (or left) side edges 403, 304 and second (or right) side edges 404, 303 thereof; wherein respective unattached top edges 411, 421 of the outer and inner pocket panels 410, 420 are narrower than the respective bottom edges 412, 422 thereof.

In the above waistband 200, the outer pocket panel 410 and the inner pocket panel 420 may be trapezoidal or approximately trapezoidal in shape. The outer pocket panel 410 and the inner pocket panel 420 may be isosceles trapezoidal or approximately isosceles trapezoidal in shape. The respective unattached top edges 411, 421 of the outer and inner pocket panels 410, 420 may form an opening 510 into the pocket 500. The front portion 300 of the waistband 200 may be one of: trapezoidal or approximately trapezoidal in shape; and, isosceles trapezoidal or approximately isosceles trapezoidal in shape. The waistband 200 may be made of an elastic material. Lateral tension developed in the waistband 200 by stretching of the elastic material when the garment 100 is worn may maintain the opening 510 into the pocket 500 in a closed position 501. The waistband 200 may include a drawcord 350 for tightening the waistband 200 when the garment 100 is worn and thereby increasing the lateral tension in the waistband 200. The drawcord 350 may extend around the front portion 300 of the waistband 200 only. And, the respective unattached top edges 411, 421 of the outer and inner pocket panels 410, 420 may be unattached for at least a portion of their respective widths.

The above embodiments may contribute to an improved pocket 500 for a garment 100 and may provide one or more advantages. First, items such as a smart phone 710 may be secured in the pocket 500 without the need for fasteners such as zippers or buttons due to the trapezoidal-like shape of the pocket 500. Second, as the opening 510 of the pocket 500 is formed along the upper edge of the back portion 400 of the waistband 200 of the garment 100, the pocket 500 is not readily apparent to an observer of the garment 100 when the pocket 500 is not in use by a wearer. Third, the pocket 500 adequately secures valuable personal items, such as smart phones 710 and keys, when the wearer is engaged in stretching, exercising, and athletic performance. Fourth, the presence of the pocket 500 does not hinder articulation, mobility, or flexibility of the garment 100.

The embodiments of the application described above are intended to be examples only. Those skilled in the art will understand that various modifications of detail may be made to these embodiments, all of which come within the scope of the application.

What is claimed is:

1. A pocket structure and waistband for a garment, comprising:

an outer pocket panel attached to an inner pocket panel along respective first side edges, second side edges, and bottom edges thereof forming a pocket therebetween and a back portion of the waistband;

a front portion of the waistband attached to the back portion along respective first side edges and second side edges thereof;

a drawcord attached to and extending from a first side edge of the back portion and a second side edge of the back portion into the front portion, wherein the drawcord extends below and proximate to an upper edge of the waistband around the front portion of the waistband only;

wherein respective unattached top edges of the outer and inner pocket panels form an uncovered opening into the pocket and are narrower than the respective bottom edges thereof; wherein the respective unattached top edges of the outer and inner pocket panels are unattached for their entire respective widths between the respective first side edges and second side edges of the outer and inner pocket panels; and, wherein the drawcord tightens the waistband when the garment is worn thereby increasing lateral tension in the waistband and stretching the top edges of the outer and inner pocket panels maintaining the opening into the pocket in a closed position.

2. The pocket structure and waistband of claim 1, wherein the outer pocket panel and the inner pocket panel are trapezoidal or approximately trapezoidal in shape.

3. The pocket structure and waistband of claim 1, wherein the outer pocket panel and the inner pocket panel are isosceles trapezoidal or approximately isosceles trapezoidal in shape.

4. The pocket structure and waistband of claim 1, wherein the waistband is made of an elastic material; and, wherein the drawcord is a single drawcord.

5. The pocket structure and waistband of claim 4, wherein the lateral tension developed in the waistband by stretching of the elastic material when the garment is worn maintains the opening into the pocket in the closed position.

6. The pocket structure and waistband of claim 1, further comprising an inner pocket liner panel and an outer pocket liner panel attached to and lining an outer side of the inner pocket panel and an inner side of the outer pocket panel, respectively.

7. The pocket structure and waistband of claim 6, wherein the inner and outer pocket liner panels are made from a moisture-wicking fabric.

8. The pocket structure and waistband of claim 1, wherein the bottom edges of the outer pocket panel and the inner pocket panel curve downwards toward each side of the garment thereby increasing a depth of the pocket at the first and second side edges of the outer and inner pocket panels to facilitate insertion of elongate items into the pocket.

9. The pocket structure and waistband of claim 1, wherein the front portion of the waistband is made from one piece of fabric that is folded over along a top edge to form inner and outer panels of the front portion of the waistband.

10. The pocket structure and waistband of claim 9, wherein the uncovered opening into the pocket is sized to not be readily apparent when not in use when the garment is viewed from at least the front and the sides.

* * * * *